US011563285B2

(12) United States Patent
Han et al.

(10) Patent No.: US 11,563,285 B2
(45) Date of Patent: Jan. 24, 2023

(54) CONNECTOR INCLUDING SUPPORT PORTION FOR SUPPORTING AT LEAST PART OF CONDUCTIVE PIN, AND ELECTRONIC DEVICE INCLUDING SAME

(71) Applicant: Samsung Electronics Co., Ltd., Gyeonggi-do (KR)

(72) Inventors: Jaeryong Han, Gyeonggi-do (KR); Inha Lee, Gyeonggi-do (KR); Hanseok Mun, Gyeonggi-do (KR)

(73) Assignee: Samsung Electronics Co., Ltd

( * ) Notice: Subject to any disclaimer, the term of this patent is extended or adjusted under 35 U.S.C. 154(b) by 97 days.

(21) Appl. No.: 17/260,773

(22) PCT Filed: Jul. 29, 2019

(86) PCT No.: PCT/KR2019/009424
§ 371 (c)(1),
(2) Date: Jan. 15, 2021

(87) PCT Pub. No.: WO2020/027528
PCT Pub. Date: Feb. 6, 2020

(65) Prior Publication Data

US 2021/0305736 A1 Sep. 30, 2021

(30) Foreign Application Priority Data

Jul. 30, 2018 (KR) ..... 10-2018-0088511

(51) Int. Cl.
*H01R 12/71* (2011.01)
*H01R 12/57* (2011.01)
*H01R 13/24* (2006.01)

(52) U.S. Cl.
CPC ..... *H01R 12/716* (2013.01); *H01R 12/57* (2013.01); *H01R 13/24* (2013.01)

(58) Field of Classification Search
CPC ..... H01R 12/716; H01R 12/57; H01R 13/24; H01R 13/20; H01R 12/73; H01R 13/639
See application file for complete search history.

(56) References Cited

U.S. PATENT DOCUMENTS 7,534,131 B2 5/2009 Chung
7,833,024 B2 * 11/2010 Takeuchi ..... H01R 13/432 439/74

(Continued)

FOREIGN PATENT DOCUMENTS

KR 1383455 8/2012
KR 20150084563 7/2015

(Continued)

OTHER PUBLICATIONS

PCT/ISA/210 Search Report issued on PCT/KR2019/009424, dated Nov. 25, 2019, pp. 5.

(Continued)

*Primary Examiner* — Abdullah A Riyami
*Assistant Examiner* — Nelson R. Burgos-Guntin
(74) *Attorney, Agent, or Firm* — The Farrell Law Firm, P.C.

(57) ABSTRACT

Disclosed is a connector. The connector comprises: an insulation member including a first sidewall portion, a second sidewall portion facing the first sidewall portion, and a bottom portion connecting the first sidewall portion to the second sidewall portion and having an opening formed between the first sidewall portion and the second sidewall portion; and a conductive pin including a fastening portion arranged on the first sidewall portion, a variable portion facing the fastening portion, and a connecting portion connecting the fastening portion to the variable portion and arranged in the opening formed on the bottom portion, wherein the bottom portion further includes a support portion extending inwardly of the opening to support the (Continued)

connecting portion, and the thickness of the support portion may be smaller than the thickness of the bottom portion. In addition, various embodiments understood from the specification can be implemented.

14 Claims, 12 Drawing Sheets

(56) References Cited

U.S. PATENT DOCUMENTS

| | | | | |
|---|---|---|---|---|
| 8,308,492 | B2 * | 11/2012 | Takeuchi | H01R 12/716 439/74 |
| 8,465,298 | B2 * | 6/2013 | Takeuchi | H01R 13/6275 439/74 |
| 8,758,029 | B2 | 6/2014 | Midorikawa | |
| 9,307,644 | B2 * | 4/2016 | Kim | H01R 13/629 |
| 10,305,205 | B2 * | 5/2019 | Yoshioka | H01R 13/405 |
| 2009/0011636 | A1 | 1/2009 | Chung | |
| 2012/0214353 | A1 | 8/2012 | Midorikawa | |
| 2013/0137308 | A1 * | 5/2013 | Chiang | H01R 12/716 439/660 |
| 2013/0210270 | A1 * | 8/2013 | Takeuchi | H01R 12/716 439/488 |
| 2015/0200477 | A1 * | 7/2015 | Kim | H05K 1/144 439/378 |

FOREIGN PATENT DOCUMENTS

| | | |
|---|---|---|
| KR | 20150089360 | 8/2015 |
| KR | 1656514 | 9/2016 |
| KR | 20170051904 | 5/2017 |

OTHER PUBLICATIONS

PCT/ISA/237 Written Opinion issued on PCT/KR2019/009424, dated Nov. 25, 2019, pp. 5.

* cited by examiner

CONNECTOR INCLUDING SUPPORT PORTION FOR SUPPORTING AT LEAST PART OF CONDUCTIVE PIN, AND ELECTRONIC DEVICE INCLUDING SAME

PRIORITY

This application is a National Phase Entry of PCT International Application No. PCT/KR2019/009424 which was filed on Jul. 29, 2019, and claims priority to Korean Patent Application No. 10-2018-0088511, which was filed on Jul. 30, 2018, the entire contents of each of which is incorporated herein by reference.

TECHNICAL FIELD

The disclosure relates to a connector including a support portion for supporting at least part of a conductive pin, and an electronic device including the connector.

BACKGROUND ART

PCBs having electronic parts mounted thereon may be contained in an electronic device. The PCBs may be electrically connected. Connectors may be mounted on the electrically-connected PCBs and may be connected through cables including corresponding connectors. In general, connectors may be referred to as sockets, and corresponding connectors may be referred to as headers. With the compactness of electronic devices, connectors contained in the electronic devices are made compact. In particular, compact connectors are required to efficiently use the areas of PCBs. Connectors, when fastened with corresponding connectors, may provide a feeling of being fastened (a feeling of clicking).

DISCLOSURE

Technical Problem

When a header of a corresponding connector is inserted into a socket of a connector, conductive pins constituting the socket of the connector may be permanently deformed beyond the elastic limit. The permanently deformed connector may fail to apply a sufficient coupling force when coupled with the corresponding connector.

Accordingly, an aspect of the disclosure is to provide a connector having a structure for ensuring a sufficient effective coupling length and preventing damage to a conductive pin.

Technical Solution

In various embodiments, a connector includes an insulating member is including a first sidewall portion, a second sidewall portion that faces the first sidewall portion, and a bottom portion that connects the first sidewall portion and the second sidewall portion and that has an opening formed between the first sidewall portion and the second sidewall portion, and a conductive pin including a fastening portion disposed on the first sidewall portion, a variable portion that faces the fastening portion, and a connecting portion that connects the fastening portion and the variable portion and that is disposed in the opening formed in the bottom portion. The bottom portion further includes a support portion extending into the opening to support the connecting portion, and the support portion has a smaller thickness than the bottom portion.

In various embodiments, a connector includes an insulating housing including a first surface, a second surface that faces the first surface, and a third surface that surrounds a space between the first surface and the second surface, the insulating housing having an insertion hole formed through the first surface and the second surface, and a conductive pin, at least part of which is inserted into the insertion hole, the conductive pin including a first portion disposed on an inner surface of the insertion hole, a second portion that faces the first portion, and a third portion that connects the first portion and the second portion. The third portion of the conductive pin is disposed in an opening of the insertion hole formed in the second surface. The insulating housing further includes a support surface extending from the second surface to support the third portion of the conductive pin, and the support surface covers part of the opening. The support surface has a smaller thickness than the third surface.

In various embodiments, an electronic device includes a first PCB that is disposed in the electronic device and that includes one or more pieces of first wiring, a first connector mounted on the first PCB and electrically connected with the first wiring, a second PCB that is disposed in the electronic device and that includes one or more pieces of second wiring, a second connector mounted on the second PCB and electrically connected with the second wiring, and a cable that electrically connects the first wiring of the first PCB and the second wiring of the second PCB. The cable includes a first corresponding connector coupled to the first connector and a second corresponding connector coupled to the second connector. Each of the first connector and the second connector includes an insulating member including a first sidewall portion, a second sidewall portion that faces the first sidewall portion, a bottom portion that connects the first sidewall portion and the second sidewall portion and that has an opening formed between the first sidewall portion and the second sidewall portion, and a support portion extending from the bottom portion into the opening to cover part of the opening, and a conductive pin including a fastening portion disposed on the first sidewall portion, a variable portion that faces the fastening portion, and a connecting portion that connects the fastening portion and the variable portion and that is supported by the support portion. The support portion has a smaller thickness than the bottom portion, and the first corresponding connector and the second corresponding connector are inserted between the fastening portions and the variable portions of the first connector and the second connector, respectively.

Advantageous Effects

According to the embodiments of the disclosure, the connectors may stably support the conductive pins while ensuring effective coupling lengths. In addition, the disclosure may provide various effects that are directly or indirectly recognized.

MODE FOR INVENTION

Hereinafter, various embodiments of the disclosure will be described with reference to the accompanying drawings. However, those of ordinary skill in the art will recognize that modifications, equivalents, and/or alternatives on the various embodiments described herein can be variously made without departing from the scope and spirit of the disclosure.

Figure 1:
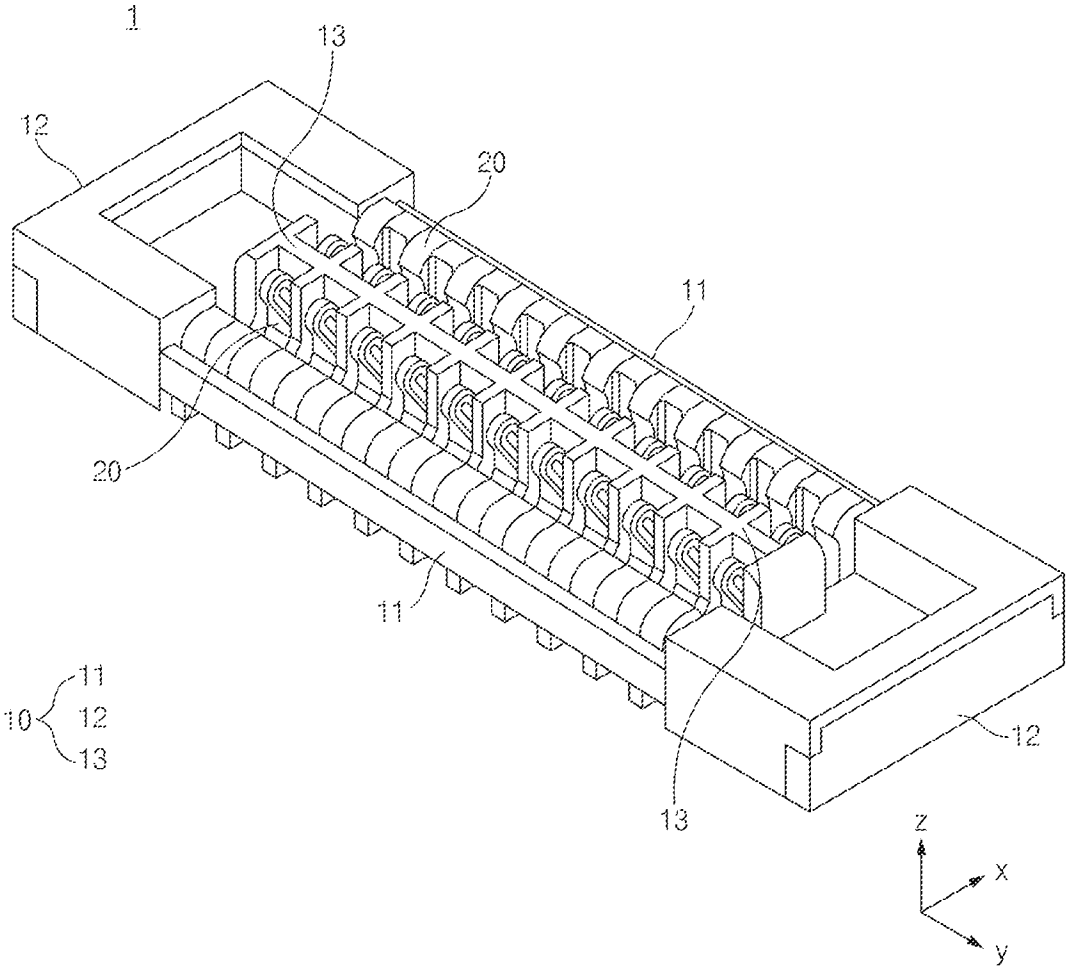
FIG. 1 is a view illustrating a connector according to an embodiment.
Figure 2:
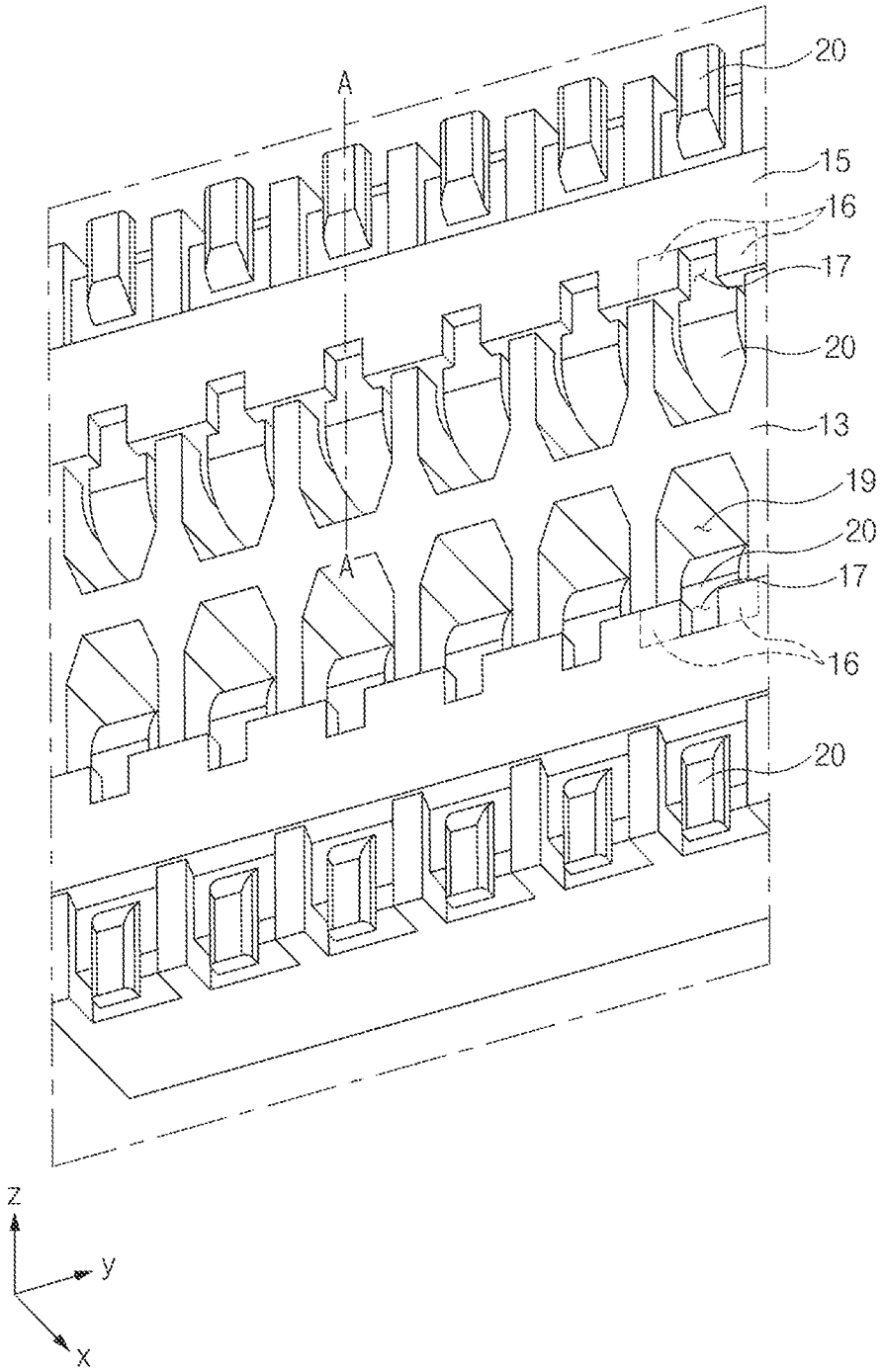
FIG. 2 is a perspective view illustrating part of a rear surface of the connector illustrated in FIG. 1.
Figure 3:
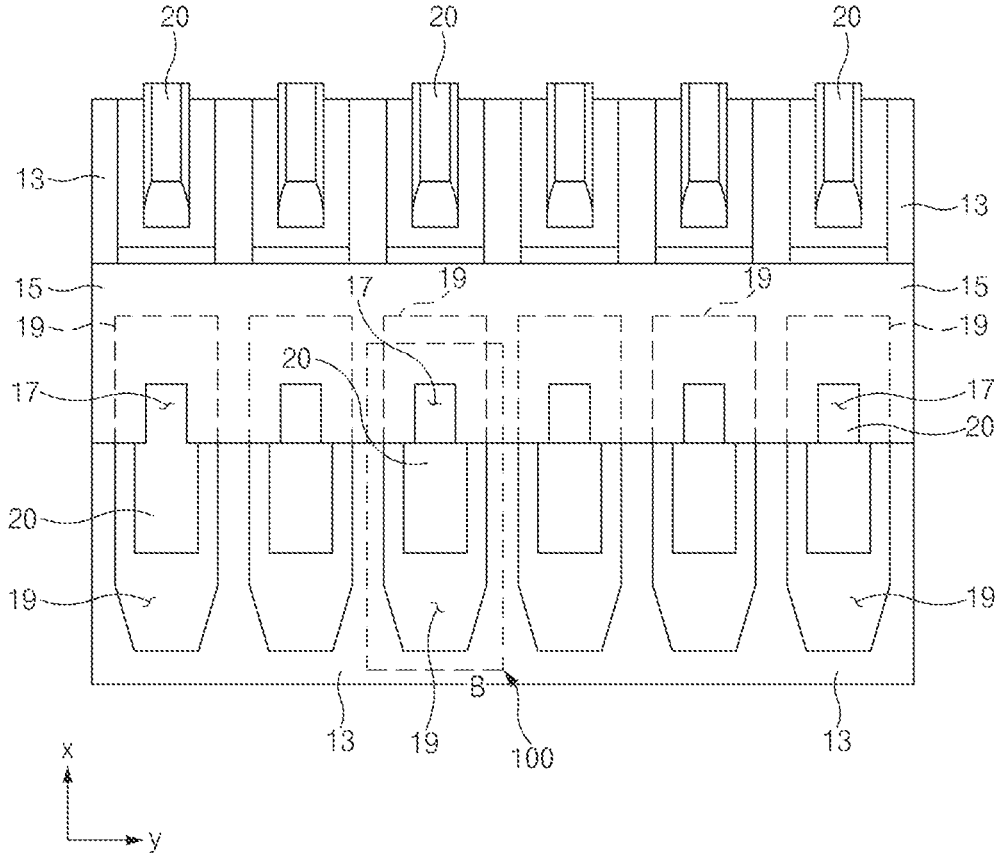
FIG. 3 is a plan view illustrating the rear surface of the connector according to an embodiment.

FIG. 1 is a view illustrating a connector assembly 1 according to an embodiment. FIG. 2 is a perspective view illustrating a rear surface of the connector assembly 1 according to an embodiment. FIG. 3 is a rear view illustrating the rear surface of the connector assembly 1 according to an embodiment.

Referring to FIG. 1, in an embodiment, the connector assembly 1 may include an insulating frame 10 and conductive pins 20 disposed in the insulating frame 10. Unlike the conductive pins 20, the insulating frame 10 may be formed of an insulating material and may be electrically insulated from the conductive pins 20. The insulating frame 10 may include a pair of first frames 11 extending in the x-axis direction and facing each other, a pair of second frames 12 that extend in the y-axis direction and face each other and that are connected with the pair of first frames 11, and partition wall frames 13 formed between the pair of first frames 11 and the pair of second frames 12. The insulating frame 10 may further include insulating brackets that are coupled to the pair of first frames 11, respectively.

in an embodiment, the partition wall frames 13 may be formed between the pair of first frames 111 and may extend in a direction parallel to the first frames 111 to divide a space formed by the first frames 11 and the second frames 112 with respect to the y-axis. The partition wall frames 13 may protrude in the x-axis direction at predetermined intervals along the y-axis direction.

Referring to FIG. 1, the entire space formed by the pair of first frames 11 and the pair of second frames 12 may be divided into a plurality of sub-spaces 19 by the partition wall frames 13, and the conductive pins 20 may be disposed in the sub-spaces 19, respectively. The conductive pins 20 disposed in the respective sub-spaces 19 may be insulated from one another by the partition wall frames 13.

Referring to FIGS. 2 and 3, the connector assembly 1 may include a support surface 15 that is formed on the insulating frame 10 and that faces in the z-axis direction. Likewise to the insulating frame 10, the support surface 15 may be formed of an insulating material and may be electrically insulated from the conductive pins 20. The support surface 15 may be separately coupled to the insulating frame 10, or may be integrally formed with the insulating frame 10. The support surface 15 may support the conductive pins 20, which are disposed in the insulating frame 10, in the z-axis direction.

One conductive pin 20 may be disposed in each of the sub-spaces 19 formed by the partition wall frames 13. The support surface 15 may cover at least part of the sub-space 19 when viewed from below. The support surface 15 may extend from one end portion to an opposite end portion of the sub-space 19 in the x-axis direction.

In an embodiment, recesses 17 may be formed on an end portion of the support surface 15 that faces in the x-axis direction, and the support surface 15 may include protruding areas 16 formed on opposite sides of each of the recesses 17. The protruding areas 16 may extend in the x-axis direction and may support the periphery of the conductive pin 20. In an embodiment, the protruding areas 16 may have a smaller thickness than the other areas of the support surface 15. Referring to FIGS. 2 and 3, when the connector assembly 1 is viewed from the rear, part of the conductive pin 20 not supported by the support surface 15 may be exposed through the recess 17.

In another embodiment, the connector assembly 1 may include an insulating housing (e.g., the insulating frame 10 of FIG. 1 and the support surface 15 of FIG. 2) and a plurality of connectors. The insulating housing (e.g., the insulating frame 10 of FIG. 1 and the support surface 15 of FIG. 2) may include a bottom portion (e.g., the support surface 15 of FIG. 2), sidewall portions (e.g., the first frames 11 and the second frames 12 of FIG. 1) that are formed on end portions of the bottom portion in the x-axis direction and that face each other, and a partition wall portion (e.g., the partition wall frames 13 of FIG. 1) that is disposed between the sidewall portions. The partition wall portion may extend in the y-axis direction, and as illustrated in FIG. 1, the connectors may be symmetrically disposed to face each other with the partition wall portion extending in the y-axis direction therebetween. Furthermore, the connectors may be arranged in the y-axis direction.

In another embodiment, a connector may include one conductive pin 20 and an insulating member surrounding at least part of the one conductive pin 20. Here, the insulating member may include part of a partition wall portion (e.g., the partition wall frames 13 of FIG. 1) and part of a sidewall portion (e.g., the first frames 11 and the second frames 12 of FIG. 1) that surround the one conductive pin 20.

Hereinafter, connectors included in the connector assembly will be described in detail with reference to FIGS. 4 to 6. Here, as illustrated in FIG. 3, a connector 100 may include one illustrated conductive pin 20 and part of an insulating frame (e.g., the insulating frame 10 of FIG. 1) that surrounds at least part of the conductive pin 20.

Figure 4A:
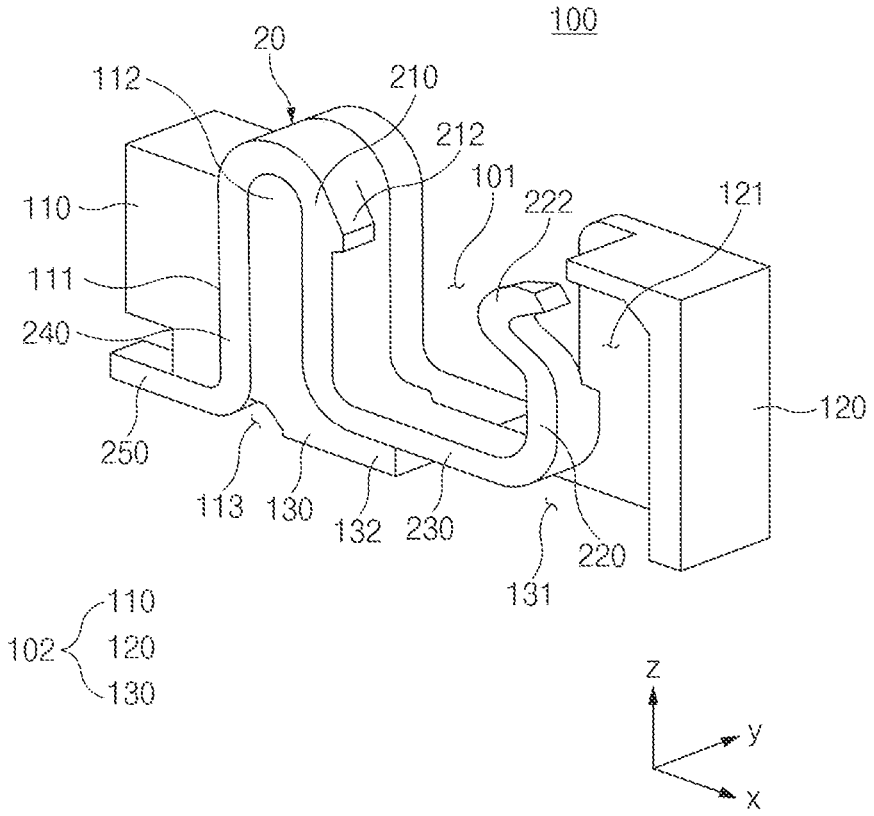
FIGS. 4A and 4B are sectional views taken along line A-A' illustrated in FIG. 2.
Figure 4B:
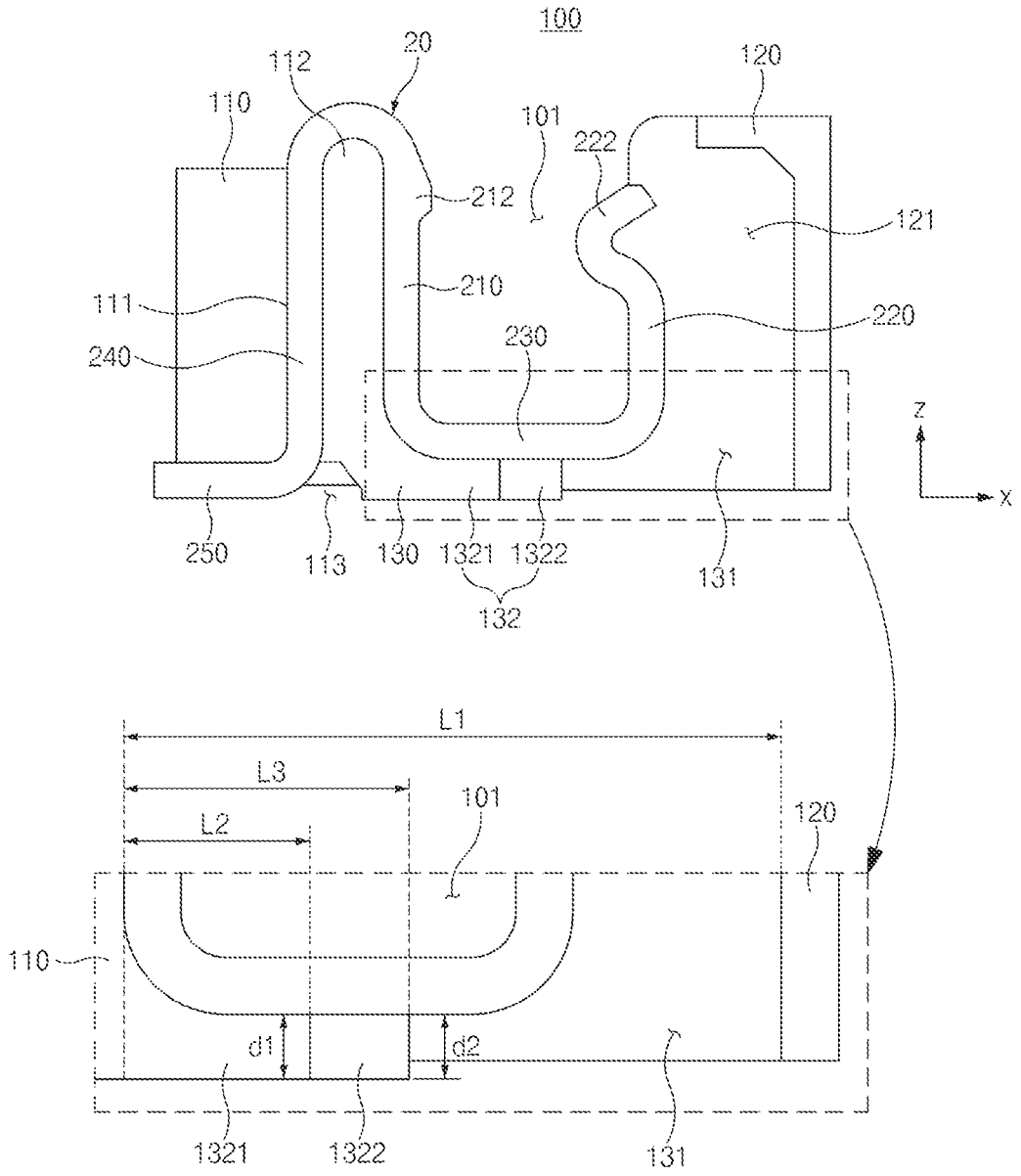

FIG. 4A is a sectional perspective view of one of the connectors according to an embodiment. FIG. 4B is a sectional view of the connector according to an embodiment. FIG. 4A is a sectional perspective view taken along line A-A' illustrated in FIG. 2.

In an embodiment, the connector 100 may include an insulating member 102 and a conductive pin 20 at least partially surrounded by the insulating member 102.

In an embodiment, the insulating member 1102 may include a bottom portion 130 having an opening 131 formed therein, a first sidewall portion 110 formed on the bottom portion 130, and a second sidewall portion 120 facing the first sidewall portion 110. A fastening space 101 in which part of the conductive pin 20 is disposed may be formed between the first sidewall portion 110 and the second sidewall portion 120. The first sidewall portion 110 may have a through-hole 111 into which part of the conductive pin 20 is inserted. The second sidewall portion 120 may have a receiving recess 121 formed thereon for receiving part of the conductive pin 20. The insulating member 102 may further include a support portion 132 that covers part of the opening 131 formed in the bottom portion 130.

In an embodiment, the conductive pin 20 may include a fastening portion 210 including a fastening protrusion 212, a variable portion 220 facing the fastening portion 210, a connecting portion 230 connecting the fastening portion 210 and the variable portion 220, and extending portions 240 and 250 extending to face away from the connecting portion 230 with respect to the fastening portion 210. The extending portions 240 and 250 may include the insertion portion 240 inserted into the through-hole 111 formed in the first sidewall portion 110 and the connection portion 250 that extends from the insertion portion 240 and that is connected to a PCB.

In an embodiment, the fastening portion 210 may be disposed on one surface of the first sidewall portion 110, and the variable portion 220 may face the fastening portion 210 and may be disposed in the receiving recess 121 formed on the second sidewall portion 120. Part of the connecting portion 230 may be disposed in the opening 131 formed in the bottom portion 130, and part of the connecting portion 230 may be supported by the support portion 132.

In an embodiment, the fastening protrusion 212 protruding toward the fastening space 101 formed between the first sidewall portion 110 and the second sidewall portion 120 may be formed on the fastening portion 210. When a corresponding connector corresponding to the connector 100 is coupled, the fastening protrusion 212 may be coupled with a corresponding fastening protrusion formed on the corresponding connector and may firmly fix the connector 100 and the corresponding connector that are coupled with each other.

In an embodiment, the variable portion 220 may include a protruding portion 222 that at least part of the variable portion 220 convexly protrudes toward the fastening space 101 to form. The protruding portion 222 may face the fastening protrusion 212 and may preferably be formed in a position corresponding to the fastening protrusion 212. The protruding portion 222 may be moved to the outside of the fastening space 101 by the corresponding connector inserted into the fastening space 101, and thus part of the variable portion 220 may be received in the receiving recess 121 formed on the second sidewall portion 120. At this time, the variable portion 220 received in the receiving recess 121 may apply an elastic force toward the inside of the fastening space 101. The elastic force may firmly maintain electrical contact between the corresponding connector and the conductive pin 20.

In an embodiment, the insertion portion 240 may fix the conductive pin 20 to the insulating member 102. For example, the insertion portion 240 may be inserted into the through-hole 111 formed in the first sidewall portion 110 of the insulating member 102, and thus the conductive pin 20 and the insulating member 102 may be coupled. A portion of the insertion portion 240 that is connected with the fastening portion 210 may be curved. A portion 112 of the insulating member 102 may be formed between the insertion portion 240 and the fastening portion 210.

The connection portion 250 may be connected with wiring of the PCB on which the connector 100 is mounted. The connection portion 250 may extend from the insertion portion 240 and may be disposed in a recess 113 formed on the bottom portion 130. The connection portion 250 may be coupled with the wiring of the PCB by soldering.

Referring to FIG. 4A, in an embodiment, one side of the support portion 132 may be connected with the first sidewall portion 110. An area of the support portion 132 that is close to the first sidewall portion 110 may have a greater thickness than an area of the support portion 132 that is relatively far away from the first sidewall portion 110.

Referring to FIG. 4B, the support portion 132 may include a first support portion 1321 and second support portions 1322 further extending beyond the first support portion 1321 in the x-axis direction. Specifically, the distance between the first sidewall portion 110 and the second sidewall portion 120 of the insulating member 102 may be L1, the first support portion 1321 may extend from the first sidewall portion 110 by L2, and the second support portions 1322 may extend from the first sidewall portion 110 by L3. The distances L1, L2, and L3 may be distances measured from a first end portion of the opening 131. In various embodiments, the ratio (L3/L1) of L3 to L1 may be about 0.6. According to an embodiment, the thickness d2 of the second support portions 1322 may be smaller than the thickness d1 of the first support portion 1321.

In some embodiments, the connector 100 may include an insulating housing (e.g., the insulating member 102) that includes a first surface, a second surface facing the first surface, and a third surface surrounding a space between the first surface and the second surface and that has a fastening hole (e.g., the fastening space 101) that is formed through the first surface and the second surface, and a conductive pin 20, at least part of which is inserted into the fastening hole, the conductive pin 20 including a first portion (e.g., the fastening portion 210) that is disposed on an inner surface of the fastening hole, a second portion (e.g., the variable portion 220) that faces the first portion, and a third portion (e.g., the connecting portion 230) that connects the first portion and the second portion. Here, based on the drawings, the first surface may include an upper surface, the second surface may include a lower surface, and the third surface may include a side surface formed between the upper surface and the lower surface. Partial areas extending from opposite sides of the fastening hole (e.g., the fastening space 101) in the y-axis direction may be open through the third surface. The fastening hole may be a space into which a corresponding connector is inserted and may be formed by the first sidewall portion 110, the second sidewall portion 120, the bottom portion 130, and the support portion 132. Meanwhile, the third portion (e.g., the connecting portion 230) of the conductive pin 20 may be disposed in the opening 131 of the fastening hole formed in the second surface, and the insulating housing (e.g., the insulating member 102) may further include a support surface (e.g., the support portion 132) that extends from the second surface and covers part of the opening 131.

In some embodiments, the third portion (e.g., the connecting portion 130) of the conductive pin 20 may extend in a lengthwise direction (e.g., the x-axis direction in the drawings). The opening 131 may extend in the x-axis direction, and the support surface may extend from a first end portion (e.g., an end portion located on a left side with respect to the drawings) to a second end portion (e.g., an end portion located on a right side with respect to the drawings) of the opening 131 in the x-axis direction. The support surface (e.g., the support portion 132) may have an increasing thickness toward the first end portion. In various embodiments, the support surface (e.g., the support portion 132) may be formed by stretching the second surface (e.g., the bottom portion 130) in the x-axis direction.

Figure 5A:
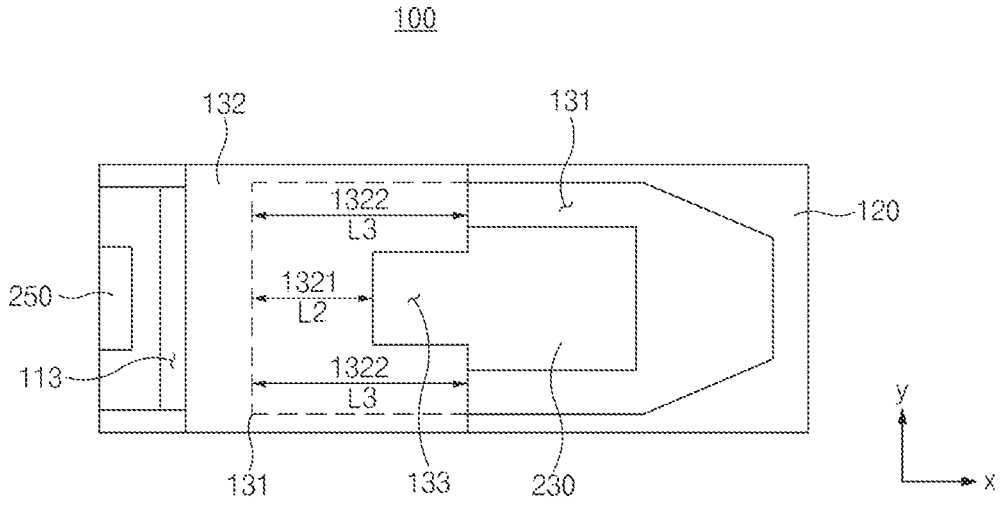
FIGS. 5A and 5B are a rear view and a plan view of the connector according to an embodiment.
Figure 5B:
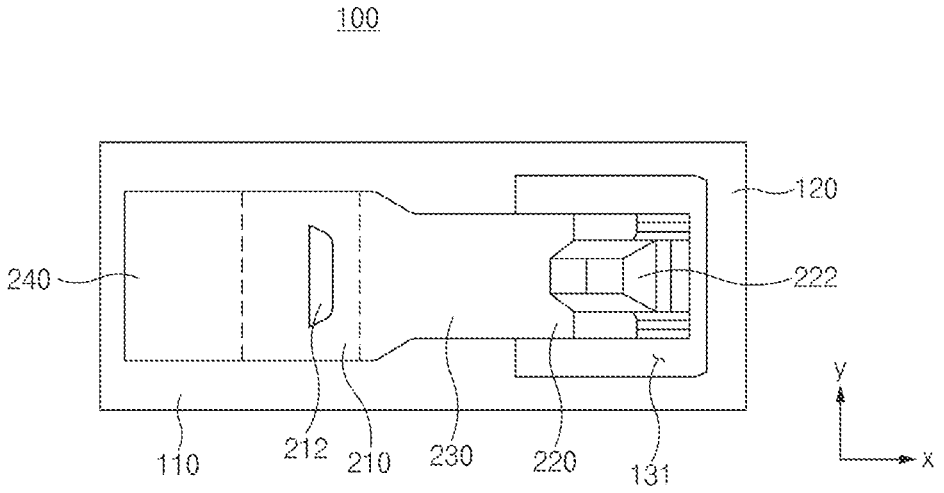

FIG. 5A is a rear view of part of the connector according to an embodiment. FIG. 5B is a plan view of part of the connector according to an embodiment. Hereinafter, the support portion of the insulating member in an embodiment will be described in detail with reference to FIGS. 5A and 5B.

Referring to FIG. 5A, the opening 131 may be formed in the bottom portion 130 of the insulating member 102. The opening 131 may be formed in an area illustrated by a dotted line, and the support portion 132 may be formed in part of the opening 131. Part of the connecting portion 230 may be disposed in the opening 131. The support portion 132 may be disposed under the connecting portion 230 to prevent the connecting portion 230 from sagging downward depending on insertion of a corresponding connector.

A recess 133 may be formed on the support portion 132, When the connector 100 is viewed from below, part of a connecting member may be exposed through the recess 133. The support portion 132 may extend from the bottom portion 130 along a lengthwise direction of part of the connecting portion 230. Opposite portions in the y-axis direction with respect to the recess 133 formed on the support portion 132 may support opposite lateral end portions of the conductive pin 20. For example, the support portion 132 may include the first support portion 1321 and the second support portions 1322 formed on opposite sides of the first support portion 1321. The first support portion 1321 may extend the second distance L2 from an end portion of the opening 131 that faces in the x-axis direction, the second support portions 1322 may extend the third distance L3 from the end portion of the opening 131 that faces in they-axis direction, and the second distance L2 may be smaller than the second distance L3.

In an embodiment, the first support portion 1321 and the second support portions 1322 may be stretched from the bottom portion 130 of the insulating member 102 by the predetermined distances L2 and L3, respectively. Accordingly, as described above with reference to FIG. 4B, the thickness d2 of the second support portions 1322 may be smaller than the thickness d1 of the first support portion 1321.

Referring to FIG. 5B, part of the conductive pin 20 may be disposed between the first sidewall portion 110 and the second sidewall portion 120. The fastening portion 210 of the conductive pin 20 may be disposed on the first sidewall portion 110, and the variable portion 220 may be disposed on the second sidewall portion 120. The fastening protrusion 212 may be formed on the fastening portion 210, and the variable portion 220 may include the protruding portion 222 that part of the variable portion 220 protrudes to form. The connecting portion 230 may be disposed over the opening 131 formed in the bottom portion 130, and the support portion 132 for supporting the connecting portion 230 may be formed in the opening 131. As described above, the first support portion 1321 may extend so as to be shorter than the second support portions 1322 in the lengthwise direction of the connecting portion 230. The second support portions 1322 may be formed to support only opposite lateral end portions of the connecting portion 230.

In various embodiments, the connector 100 may preferably have a sufficient effective coupling length so as to be stably coupled with the corresponding connector. As the effective coupling length increases, a coupling area of the conductive pin 20 of each of the connector 100 and the corresponding connector may increase. The effective coupling length, when viewed in FIG. 4B, may be recognized as the length of the fastening portion 210 and the variable portion 220 in the z-axis direction. In other words, the effective coupling length may be proportional to the height of the connector 100.

Meanwhile, the connector 100 for connecting a PCB may be generally used to connect PCBs in an electronic device. Because electronic devices, such as smartphones, have a small thickness and/or include a plurality of different parts therein, the height of the connector 100 may be limited.

Accordingly, to increase the effective coupling length to the maximum in the connector 100 having a constant height, it may be considered to reduce the thickness of the support portion 132. However, there may be a limitation in the reduction of the thickness of the support portion 132 through a general process of forming the insulating member. In another example, it may be considered to omit or shorten the support portion 132. In this case, the corresponding connector inserted into the fastening space may not be supported with sufficient strength, and therefore the connecting portion 230 may sag downward.

The sagging of the connecting portion 230 may mean that the connecting portion 230 is permanently deformed beyond the elastic limit. In the case where the connecting portion 230 is permanently deformed, the variable portion 220 extending from the connecting portion 230 may be farther away from the corresponding connector. Therefore, the variable portion 220 may fail to apply a sufficient elastic force for fixing the corresponding connector.

In consideration of the aforementioned problems, the bottom portion 130 may be stretched toward the opening 131 in which the connecting portion 230 is disposed, and thus the connector 100 according to an embodiment may provide the support portion 132 having a small thickness. In various embodiments, the support portion having the small thickness may be formed by forming and then stretching the bottom portion, or by adding a thin rib. In various embodiments, to limit an increase in the height of the connector at the same time as preventing the connecting portion 230 from sagging downward, the support portion 132 may further include the second support portions 1322 that support only the opposite lateral end portions of the connecting portion 230.

In an embodiment, considering the above premise, the ratio of the length of the support portion 132 to the gap between the first sidewall portion 110 and the second sidewall portion 120 may be at least about 0.6 or more. The connector 100, to which the ratio is applied, may prevent permanent deformation of the connecting portion 230 of the conductive pin 20 despite insertion of the corresponding connector.

Figure 6:
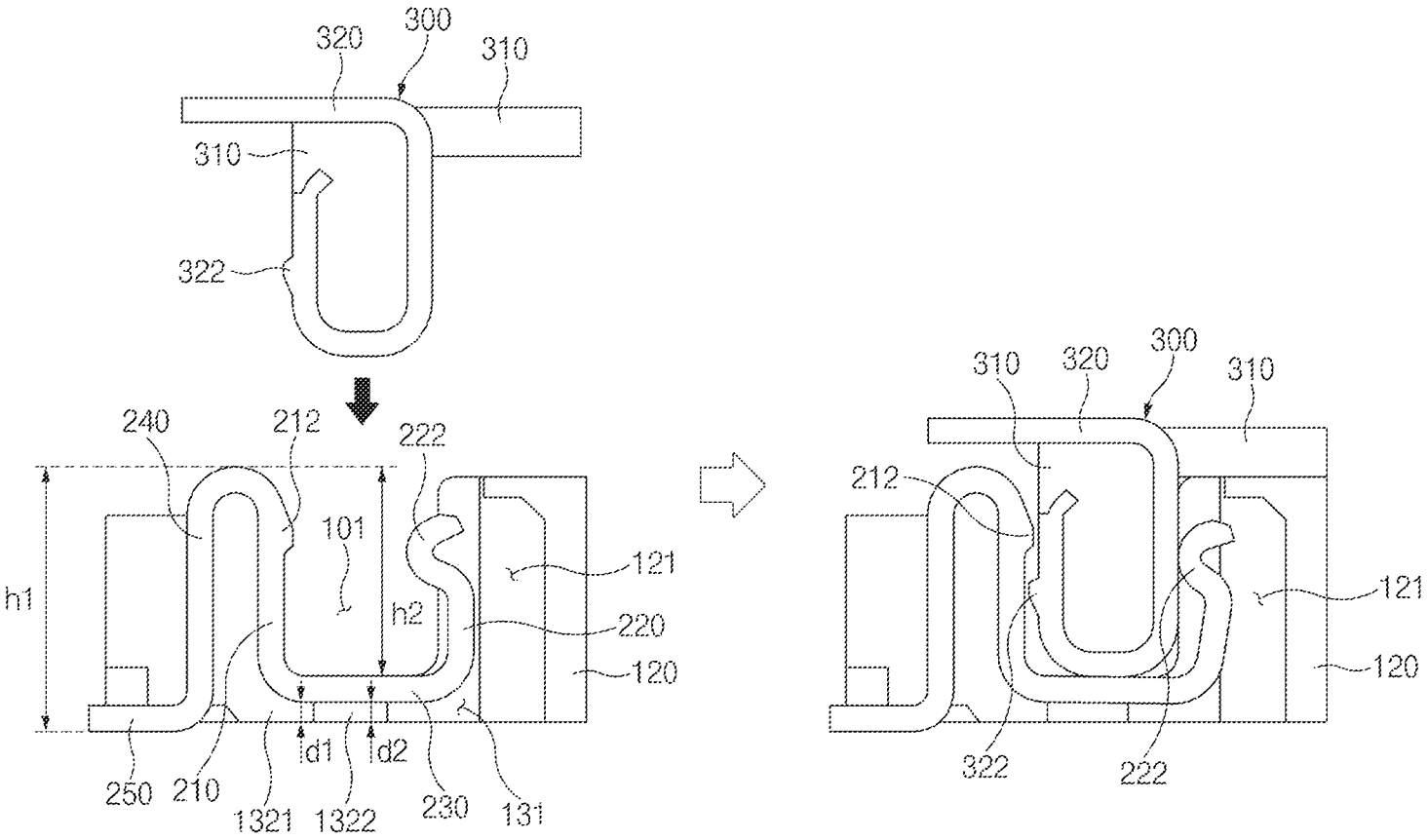
FIG. 6 is a view illustrating a coupling of the connector and a corresponding connector according to an embodiment.

FIG. 6 is a illustrating a coupling of the connector and the corresponding connector according to an embodiment.

Referring to FIG. 6, the connector 100 may be fastened with the corresponding connector 300 as the corresponding connector 300 is inserted into the fastening space 101. The fastening space 101 may be formed between the fastening portion 210 and the variable portion 220. Depending on the insertion of the corresponding connector 300, at least part of the variable portion 220 may be varied within the elastic limit. For example, at least part of the variable portion 220 may move into the receiving recess 121 formed on the second sidewall portion 120 of the insulating member. The protruding portion 222 that part of the variable portion 220 protrudes to form may press a corresponding conductive pin 320 of the corresponding connector 300, and thus the corresponding connector 300 and the connector 100 may be firmly fastened with each other. Meanwhile, the fastening protrusion 212 formed on the fastening portion 210 may be fastened with a corresponding fastening protrusion 322 formed on the corresponding connector 300.

Referring to FIG. 6, the height of the connector 100 may be h1, and the effective coupling length may be h2 that is a length from an upper surface of the connector 100 to the connecting portion 230 of the conductive pin. The height of the connector may be limited depending on an electronic device in which the connector is included, and as the effective coupling length increases, electrical connection between the connector and the corresponding connector may be stable. Accordingly, to increase the effective coupling length h2 under the assumption that the connector height h1 is fixed, it may be considered to remove the support portions 1321 and 1322. However, in the case of removing the support portions 1321 and 1322, the connecting portion 230 by which the corresponding connector 300 is supported may sag downward, or may be permanently deformed beyond the elastic limit. Accordingly, to form the support portions 1321 and 1322 of the connector 100 as thin as possible, the second support portions 1322 may be formed by stretching the first support portion 1321, or the second support portions 1322 may be formed by adding a thin rib to part of the first support portion 1321. To this end, the thickness of the second support portions 1322 may be smaller than the thickness of the first support portion 1321.

Figure 7:
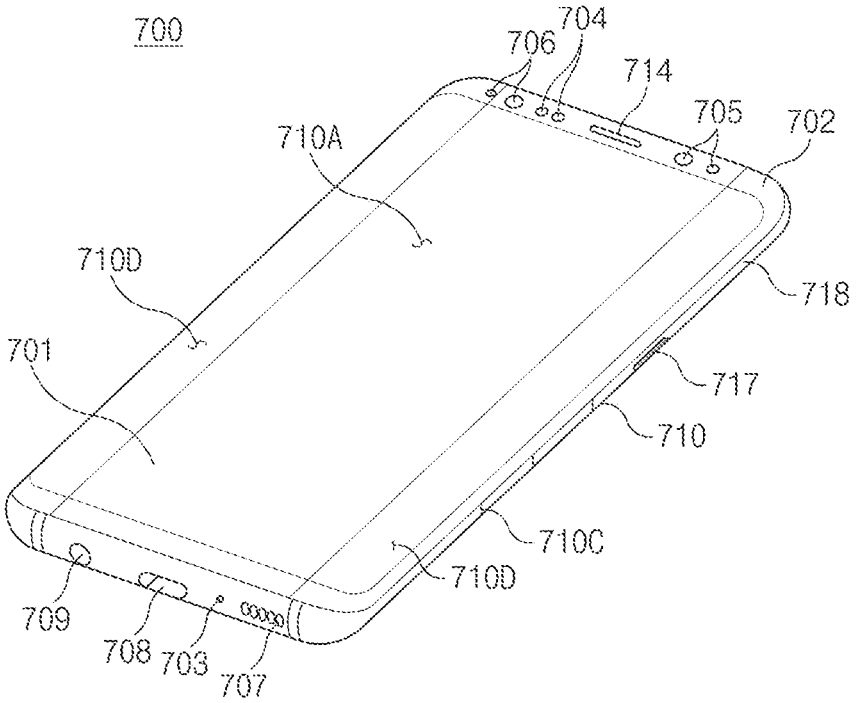
FIG. 7 is a front perspective view of a mobile electronic device according to an embodiment.
Figure 8:
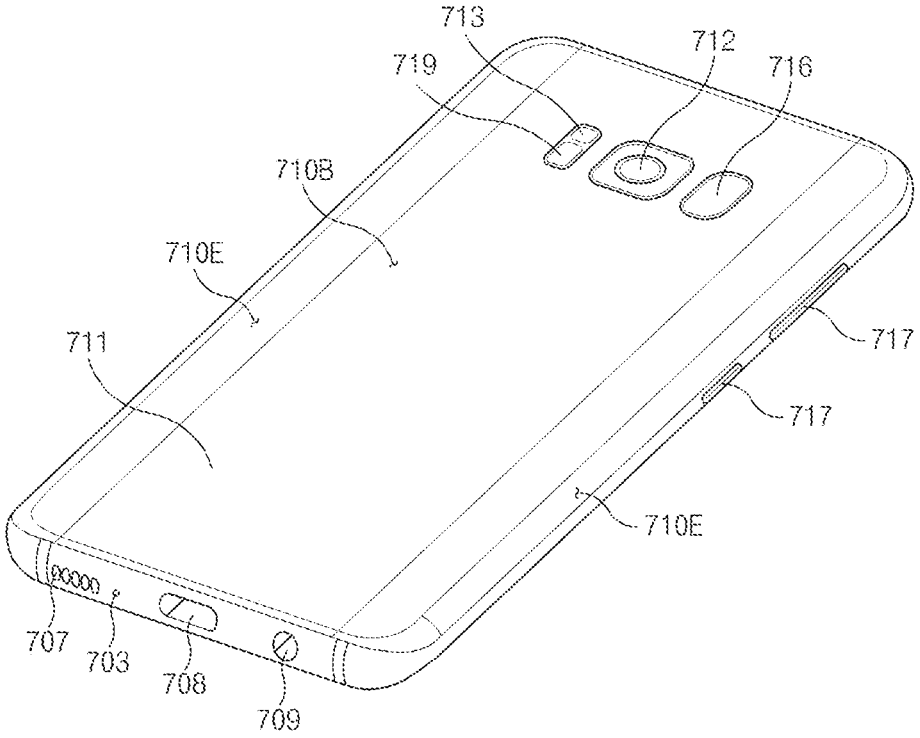
FIG. 8 is a rear perspective view of the electronic device of FIG. 7.
Figure 9:
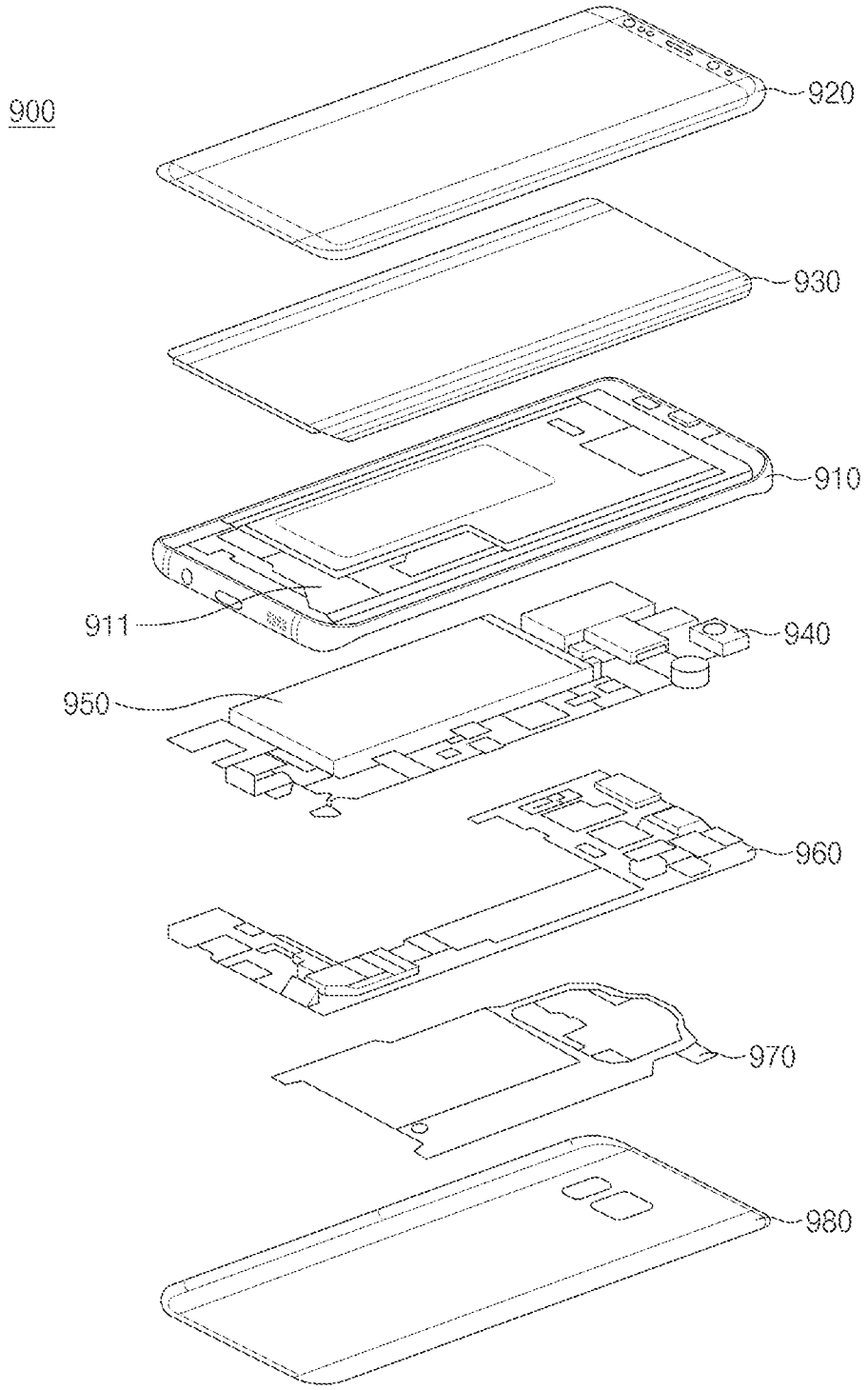
FIG. 9 is an exploded perspective view of the electronic device of FIG. 7.

FIG. 7 is a front perspective view of a mobile electronic device according to an embodiment, FIG. 8 is a rear perspective view of the electronic device of FIG. 7. FIG. 9 is an exploded perspective view of the electronic device of FIG. 7.

Referring to FIGS. 7 and 8, the electronic device 700 according to an embodiment may include a housing 710 that includes a first surface (or, a front surface) 710A, a second surface (or, a rear surface) 710B, and side surfaces 7100 surrounding a space between the first surface 710A and the second surface 710B. In another embodiment (not illustrated), a housing may refer to a structure that forms some of the first surface 710A, the second surface 710B and the side surfaces 710C of FIG. 7. According to an embodiment, the first surface 710A may be formed by a front plate 702, at least part of which is substantially transparent (e.g., a glass plate including various coating layers, or a polymer plate). The second surface 710B may be formed by a back plate 711 that is substantially opaque. The back plate 711 may be formed of, for example, coated or colored glass, ceramic, polymer, metal (e.g., aluminum, stainless steel (STS), or magnesium), or a combination of at least two of the aforementioned materials. The side surfaces 710C may be formed by a side bezel structure (or, a "side member") 718 that is coupled with the front plate 702 and the back plate 711 and that contains metal and/or a polymer. In some embodiments, the back plate 711 and the side bezel structure 718 may be integrally formed with each other and may contain the same material (e.g., a metallic material such as aluminum).

In the illustrated embodiment, the front plate 702 may include, at opposite long edges of the front plate 702, two first areas 110D that curvedly and seamlessly extend from the first surface 710A toward the back plate 711. In the illustrated embodiment (refer to FIG. 8), the back plate 711 may include, at opposite long edges thereof, two second areas 710E that curvedly and seamlessly extend from the second surface 710B toward the front plate 702. In some embodiments, the front plate 702 (or, the back plate 711) may include only one of the first areas 710D (or, the second areas 710E). In another embodiment, a part of the first areas 710D or the second areas 710E may not be included. In the embodiments, when viewed from a side of the electronic device 700, the side bezel structure 718 may have a first thickness (or, width) at sides not including the first areas 710D or the second areas 710E and may have a second thickness smaller than the first thickness at sides including the first areas 710D or the second areas 710E.

According to an embodiment, the electronic device 700 may include at least one of a display 701, audio modules 703, 707, and 714, sensor modules 704, 716, and 719, camera modules 705, 712, and 713, key input devices 717, a light emitting element 706, and connector holes 708 and 709. In some embodiments, the electronic device 700 may omit at least one component (e.g., the key input devices 717 or the light emitting element 706) among the aforementioned components, or may additionally include other component(s).

The display 701, for example, may be exposed through most of the front plate 702. In some embodiments, at least part of the display 701 may be exposed through the front plate 702 that forms the first surface 710A and the first areas 710D of the side surfaces 7100. In some embodiments, the periphery of the display 701 may be formed to be substantially the sane as the shape of the adjacent periphery of the front plate 702. In another embodiment (not illustrated), the gap between the periphery of the display 701 and the periphery of the front plate 702 may be substantially constant to expand the area by which the display 701 is exposed.

In another embodiment (not illustrated), recesses or openings may be formed in part of a screen display area of the display 701, and the electronic device 700 may include at least one of the audio module 714 the sensor module 704, the camera module 705, and the light emitting element 706 that are aligned with the recesses or the openings. In another embodiment (not illustrated), the electronic device 700 may include, on a rear surface of the screen display area of the display 701, at least one of the audio module 714, the sensor module 704, the camera module 705, the fingerprint sensor 716, and the light emitting element 706. In another embodiment (not illustrated), the display 701 may be combined with, or disposed adjacent to, touch detection circuitry, a pressure sensor for measuring the intensity (pressure) of a touch, and/or a digitizer for detecting a stylus pen of a magnetic field type. In some embodiments, at least a part of the sensor modules 704 and 719 and/or at least a part of the key input devices 717 may be disposed in the first areas 710D and/or the second areas 710E.

The audio modules 703, 707, and 714 may include the microphone hole 703 and the speaker holes 707 and 714. A microphone for obtaining a sound from the outside may be disposed in the microphone hole 703, and in some embodiments, a plurality of microphones may be disposed in the microphone hole 103 to detect the direction of a sound. The speaker holes 707 and 714 may include the external speaker hole 707 and the receiver hole 714 for a telephone call. In some embodiments, the speaker holes 707 and 714 and the microphone hole 703 may be implemented with a single hole, or a speaker (e.g., a piezo speaker) may be included without the speaker holes 707 and 714.

The sensor modules 704, 716, and 719 may generate an electrical signal or a data value that corresponds to an operational state inside the electronic device 700 or an environmental state external to the electronic device 700. The sensor modules 704, 716, and 719 may include, for example, the first sensor module 704 (e.g., a proximity sensor) and/or the second sensor module (not illustrated)

(e.g., a fingerprint sensor) that is disposed on the first surface 710A of the housing 710, and/or the third sensor module 719 (e.g., an HRM sensor) and/or the fourth sensor module 716 (e.g., a fingerprint sensor) that is disposed on the second surface 710B of the housing 710. The fingerprint sensor may be disposed not only on the first surface 710A of the housing 710 (e.g., the display 701) but also on the second surface 710B. The electronic device 700 may further include a non-illustrated sensor module, which may be, for example, at least one of a gesture sensor, a gyro sensor, an atmospheric pressure sensor, a magnetic sensor, an acceleration sensor, a grip sensor, a color sensor, an infrared (IR) sensor, a biosensor, a temperature sensor, a humidity sensor, or the illuminance sensor 704.

The camera modules 705, 712, and 713 may include the first camera device 705 disposed on the first surface 710A of the electronic device 700, and the second camera device 712 and/or the flash 713 disposed on the second surface 710B. The camera devices 705 and 112 may include one or more lenses, an image sensor, and/or an image signal processor. The flash 713 may include, for example, a light emitting diode or a xenon lamp. In some embodiments, two or more lenses (an IR camera lens, a wide angle lens, and a telephoto lens) and image sensors may be disposed on one surface of the electronic device 700.

The key input devices 717 may be disposed on the side surfaces 710C of the housing 710. In another embodiment, the electronic device 700 may not include all or some of the aforementioned key input devices 717, and the key input devices 717 not included may be implemented in a different form such as a soft key on the display 701. In some embodiments, the key input devices may include the sensor module 716 disposed on the second surface 710B of the housing 710.

The light emitting element 706, for example, may be disposed on the first surface 710A of the housing 710. For example, the light emitting element 706 may provide state information of the electronic device 700 in the form of light. In another embodiment, the light emitting element 706 may provide, for example, a light source that operates in conjunction with operation of the camera module 705. The light emitting element 706 may include, for example, an LED, an IR LED, and a xenon lamp.

The connector holes 708 and 709 may include the first connector hole 708 for receiving a connector (e.g., a USB connector) for transmitting and receiving electric power and/or data with an external electronic device, and/or the second connector hole 709 (e.g., an earphone jack) for receiving a connector for transmitting and receiving audio signals with an external electronic device.

Referring to FIG. 9, an electronic device 900 may include a side bezel structure 910, a first support member 911 (e.g., a bracket), a front plate 920, a display 930, a printed circuit board 940, a battery 950, a second support member 960 (e.g., a rear case), an antenna 970, and a back plate 980. In some embodiments, the electronic device 900 may omit at least one component (e.g. the first support me member 911 or the second support member 960) among the aforementioned components, or may additionally include other component(s). At least one of the components of the electronic device 900 may be the same as, or similar to, at least one of the components of the electronic device 700 of FIG. 7 or 8, and repetitive descriptions will hereinafter be omitted.

The first support member 911 may be disposed inside the electronic device 900 and may be connected with the side bezel structure 910, or may be integrally formed with the side bezel structure 910. The first support member 911 may be formed of, for example, a metallic material and/or a nonmetallic (e.g., polymer) material. The display 930 may be coupled to one surface of the first support member 911, and the printed circuit board 940 may be coupled to an opposite surface of the first support member 911. The printed circuit board 940 may have a processor, a memory, and/or an interface mounted thereon. The processor may include, for example, one or more of a central processing unit, an application processor, a graphic processing unit, an image signal processor, a sensor hub processor, or a communication processor.

In various embodiments, the second support member 960 may include a printed circuit board having one or more electrical elements mounted thereon or an antenna PCB having an antenna module mounted thereon.

In various embodiments, the electronic device 900 (e.g., the electronic device 700 of FIG. 7) may include a connector (e.g., the connector assembly 1 of FIG. 1 or the connector 100 of FIG. 4A) for electrically connecting PCBs. For example, the connector may electrically connect a first PCB (e.g., the printed circuit board 940) and a second PCB (e.g., the second support member 960), or may electrically connect one of the processor, the memory, and/or the interface mounted on the printed circuit board with another one.

In various embodiments, the first PCB may include first wiring and a first connector (e.g., the connector assembly 1 of FIG. 1 or the connector 100 of FIG. 4A) that is connected with the first wiring, and the second PCB may include second wiring and a second connector (e.g., the connector assembly 1 of FIG. 1 or the connector 100 of FIG. 4A) that is connected with the second wiring. The electronic device 900 (e.g., the electronic device 700 of FIG. 7) may include a cable for connecting the first connector (e.g., the connector assembly 1 of FIG. 1 or the connector 100 of FIG. 4A) and the second connector (e.g., the connector assembly 1 of FIG. 1 or the connector 100 of FIG. 4A), and the cable may include a first corresponding connector (e.g., the corresponding connector 300 of FIG. 6) that corresponds to the first connector and a second corresponding connector (e.g., the corresponding connector 300 of FIG. 6) that corresponds to the second connector. The first corresponding connector may be coupled to the first connector, and the second corresponding connector may be coupled to the second connector. Accordingly, the first PCB and the second PCB may be electrically connected.

The memory may include, for example, a volatile memory or a nonvolatile memory.

The interface may include, for example, a high definition multimedia interface (HDMI), a universal serial bus (USB) interface, an SD card interface, and/or an audio interface. For example, the interface may electrically or physically connect the electronic device 900 with an external electronic device and may include a USB connector, an SD card/MMC connector, or an audio connector.

The battery 950, which is a device for supplying electric power to at least one component of the electronic device 900, may include, for example, a primary cell that is not rechargeable, a secondary cell that is rechargeable, or a fuel cell. At least part of the battery 950, for example, may be disposed on substantially the same plane as the printed circuit board 940. The battery 950 may be integrally disposed inside the electronic device 900, or may be disposed so as to be detachable from the electro device 900.

The antenna 970 may be disposed between the back plate 980 and the battery 950. The antenna 970 may include, for example, a near field communication (NFC) antenna, a wireless charging antenna, and/or a magnetic secure transmission (MST) antenna. For example, the antenna 970 may perform short-range communication with an external device, or may wirelessly transmit and receive electric power required for charging. In another embodiment, an antenna structure may be formed by part of the side bezel structure 910 and/or part of the support member 911, or a combination thereof.

Figure 10:
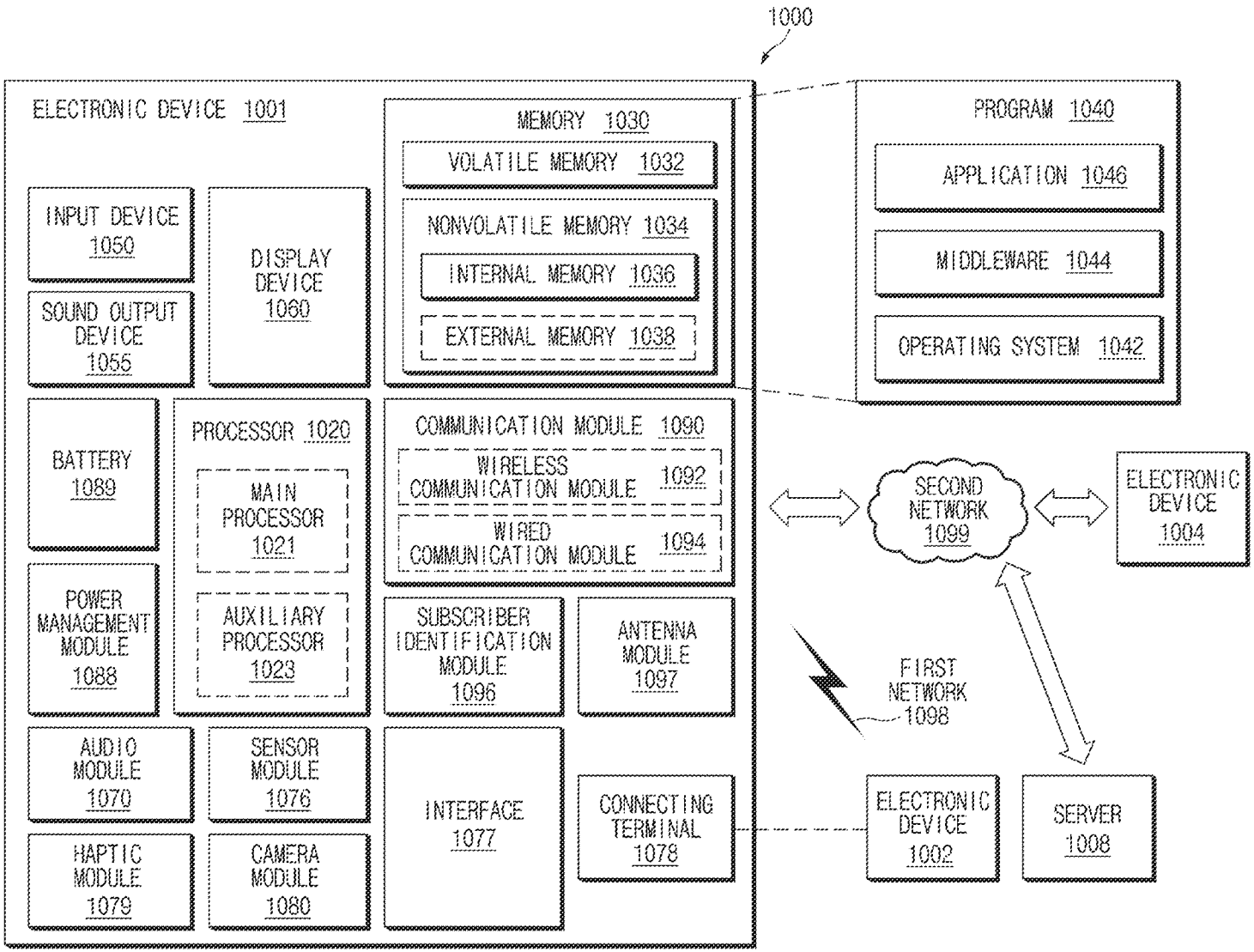
FIG. 10 is a block diagram of an electronic device in a network environment according to various embodiments.

FIG. 10 is a block diagram illustrating an electronic device 1001 in a network environment 1000 according to various embodiments. Referring to FIG. 10, the electronic device 1001 in the network environment 1000 may communicate with an electronic device 1002 via a first network 1098 (e.g., a short-range wireless communication network), or an electronic device 1004 or a server 1008 via a second network 1099 (e.g., a long-range wireless communication network). According to an embodiment, the electronic device 1001 may communicate with the electronic device 1004 via the server 1008. According to an embodiment, the electronic device 1001 may include a processor 1020, memory 1030, an input device 1050, a sound output device 1055, a display device 1060, an audio module 1070, a sensor module 1076, an interface 1077, a haptic module 1079, a camera module 1080, a power management module 1088, a battery 1089, a communication module 1090, a subscriber identification module (SIM) 1096, or an antenna module 1097. In some embodiments, at least one (e.g., the display device 1060 or the camera module 1080) of the components may be omitted from the electronic device 1001, or one or more other components may be added in the electronic device 1001. In some embodiments, some of the components may be implemented as single integrated circuitry. For example, the sensor module 1076 (e.g., a fingerprint sensor, an iris sensor, or an illuminance sensor) may be implemented as embedded in the display device 1060 (e.g., a display).

The processor 1020 may execute, for example, software (e.g., a program 1040) to control at least one other component (e.g., a hardware or software component) of the electronic device 1001 coupled with the processor 1020, and may perform various data processing or computation. According to one embodiment, as at least part of the data processing or computation, the processor 1020 may load a command or data received from another component (e.g., the sensor module 1076 or the communication module 1090) in volatile memory 1032, process the command or the data stored in the volatile memory 1032, and store resulting data in non-volatile memory 1034. According to an embodiment, the processor 1020 may include a main processor 1021 (e.g., a central processing unit (CPU) or an application processor (AP)), and an auxiliary processor 1023 (e.g., a graphics processing unit (GPU), an image signal processor (ISP), a sensor hub processor, or a communication processor (CP)) that is operable independently from, or in conjunction with, the main processor 1021. Additionally or alternatively, the auxiliary processor 1023 may be adapted to consume less power than the main processor 1021, or to be specific to a specified function. The auxiliary processor 1023 may be implemented as separate from, or as part of the main processor 1021.

The auxiliary processor 1023 may control at least some of functions or states related to at least one component (e.g., the display device 1060, the sensor module 1076, or the communication module 1090) among the components of the electronic device 1001, instead of the main processor 1021 while the main processor 1021 is in an inactive (e.g., sleep) state, or together with the main processor 1021 while the main processor 1021 is in an active state (e.g., executing an application). According to an embodiment, the auxiliary processor 1023 (e.g., an image signal processor or a communication process may be implemented as part of another component (e.g., the camera module 1080 or the communication module 1090) functionally related to the auxiliary processor 1023.

The memory 1030 may store various data used by at least one component (e.g., the processor 1020 or the sensor module 1076) of the electronic device 1001. The various data may include, for example, software (e.g., the program 1040) and input data or output data for a command related thererto. The memory 1030 may include the volatile memory 1032 or the film-volatile memory 1034.

The program 1040 may be stored in the memory 1030 as software, and may include, for example, an operating system (OS) 1042, middleware 1044, or an application 1046.

The input device 1050 may receive a command or data to be used by other component (e.g., the processor 1020) of the electronic device 1001, from the outside (e.g., a user) of the electronic device 1001. The input device 1050 may include, for example, a microphone, a mouse, a keyboard, or a digital pen (e.g., a stylus pen).

The sound output device 1055 may output sound signals to the outside of the electronic device 1001. The sound output device 1055 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 1060 may visually provide information to the outside (e.g., a user) of the electronic device 1001. The display device 1060 may include, for example, a display, a hologram device, or a projector and control circuitry to control a corresponding one of the display, hologram device, and projector. According to an embodiment, the display device 1060 may include touch circuitry adapted to detect a touch, or sensor circuitry (e.g., a pressure sensor) adapted to measure the intensity of force incurred by the touch.

The audio module 1070 may convert a sound into an electrical signal and vice versa. According to an embodiment the audio module 1070 may obtain the sound via the input device 1050, or output the sound via the sound output device 1055 or a headphone of an external electronic device (e.g., an electronic device 1002) directly (e.g., wiredly) or wirelessly coupled with the electronic device 1001.

The sensor module 1076 may detect an operational state (e.g., power or temperature) of the electronic device 1001 or an environmental state (e.g., a state of a user) external to the electronic device 1001, and then generate an electrical signal or data value corresponding to the detected state. According to an embodiment, the sensor module 1076 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 1077 may support one or more specified protocols to be used for the electronic device 1001 to be coupled with the external electronic device (e.g., the electronic device 1002) directly (e.g., wiredly) or wirelessly. According to an embodiment, the interface 1077 may include, for example, a high definition multimedia interface (HDMI), a universal serial bus (USB) interface, a secure digital (SD) card interface, or an audio interface.

A connecting terminal 1078 may include a connector via which the electronic device 1001 may be physically connected with the external electronic device (e.g., the electronic device 1002). According to an embodiment, the connecting terminal 1078 may include, for example, a HDMI connector, a USB connector, a SD card connector, or an audio connector (e.g., a headphone connector).

The haptic module 1079 may convert an electrical signal into a mechanical stimulus (e.g., a vibration or a movement) or electrical stimulus which may be recognized by a user via his tactile sensation or kinesthetic sensation. According to an embodiment, the haptic module 1079 may include, for example, a motor, a piezoelectric element, or an electric stimulator.

The camera module 1080 may capture a still image or moving images. According to an embodiment, the camera module 1080 may include one or more lenses, image sensors, image signal processors, or flashes.

The power management module 1088 may manage power supplied to the electronic device 1001. According to one embodiment, the power management module 1088 may be implemented as at least part of, for example, a power management integrated circuit (PMIC).

The battery 1089 may supply power to at least one component of the electronic device 1001. According to an embodiment, the battery 1089 may include, for example, a primary cell which is not rechargeable, a secondary cell which is rechargeable, or a fuel cell.

The communication module 1090 may support establishing a direct (e.g., wired) communication channel or a wireless communication channel between the electronic device 1001 and the external electronic device (e.g., the electronic device 1002, the electronic device 1004, or the server 1008) and performing communication via the established communication channel. The communication module 1090 may include one or more communication processors that are operable independently from the processor 1020 (e.g., the application processor (AP)) and supports a direct (e.g., wired) communication or a wireless communication. According to an embodiment, the communication module 1090 may include a wireless communication module 1092 (e.g., a cellular communication module, a short-range wireless communication module, or a global navigation satellite system (GNSS) communication module) or a wired communication module 1094 (e.g., a local area network (LAN) communication module or a power line communication (PLC) module). A corresponding one of these communication modules may communicate with the external electronic device via the first network 1098 (e.g., a short-range, communication network, such as Bluetooth™, wireless-fidelity (Wi-Fi) direct, or infrared data association (IrDA)) or the second network 1099 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 1092 may identify and authenticate the electronic device 1001 in a communication network, such as the first network 1098 or the second network 1099, rising subscriber information (e.g., international mobile subscriber identity (IMSI)) stored in the subscriber identification module 1096.

The antenna module 1097 may transmit or receive a signal or power to or from the outside (e.g., the external electronic device) of the electronic device 1001. According to an embodiment, the antenna module 1097 may include an antenna including a radiating element composed of a conductive material or a conductive pattern formed in or on a substrate (e.g., PCB). According to an embodiment, the antenna module 1097 may include a plurality of antennas. In such a case, at east one antenna appropriate for a communication scheme used in the communication network, such as the first network 1098 or the second network 1099, may be selected, for example, by the communication module 1090 (e.g., the wireless communication module 1092) from the plurality of antennas. The signal or the power may then be transmitted or received between the communication module 1090 and the external electronic device via the selected at least one antenna. According to an embodiment, another component (e.g., a radio frequency integrated circuit (RFIC)) other than the radiating element may be additionally formed as part of the antenna module 1097.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 1001 and the external electronic device 1004 via the server 1008 coupled with the second network 1099. Each of the electronic devices 1002 and 1004 may be a device of a same type as, or a different type, from the electronic device 1001. According to an embodiment, all or some of operations to be executed at the electronic device 1001 may be executed at one or more of the external electronic devices 1002, 1004, or 1008. For example, if the electronic device 1001 should perform a function or a service automatically, or in response to a request from a user or another device, the electronic device 1001, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 1001. The electronic device 1001 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block" "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 1040) including one or more instructions that are stored in a storage medium (e.g., internal memory 1036 or external memory 1038) that is readable by a machine (e.g., the electronic device 1001). For example, a processor (e.g., the processor 1020) of the machine (e.g., the electronic device 1001) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate, between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

The invention claimed is:

1. A connector comprising:

an insulating member including a first sidewall portion, a second sidewall portion configured to face the first sidewall portion, and a bottom portion configured to connect the first sidewall portion and the second sidewall portion, the bottom portion having an opening formed between the first sidewall portion and the second sidewall portion; and a conductive pin including a fastening portion disposed on the first sidewall portion, a variable portion configured to face the fastening portion, and a connecting portion configured to connect the fastening portion and the variable portion and disposed in the opening formed in the bottom portion, wherein the bottom portion includes a support portion having a smaller thickness than the bottom portion and extending into the opening, the support portion being configured to support the connecting portion, wherein the support portion includes:

a first area extending from an edge of the opening in a lengthwise direction of the connecting portion by a first distance; and second areas formed on opposite sides of the first area, the second areas extending from the edge of the opening in the lengthwise direction of the connecting portion by a second distance greater than the first distance, and wherein the second areas support opposite lateral end portions of the connecting portion.

2. The connector of claim 1, wherein the support portion extends from the fastening portion to cover part of the opening, wherein the support portion includes a first support portion disposed in a first lateral end portion of the opening and configured to support a first lateral end portion of the connecting portion, a second support portion disposed in a second lateral end portion of the opening and configured to support a second lateral end portion of the connecting portion, and a third support portion formed between the first support portion and the second support portion, and wherein the third support portion has a smaller length than the first support portion or the second support portion.

3. The connector of claim 2, wherein the third support portion has a greater thickness than the first support portion or the second support portion.

4. The connector of claim 1, wherein the variable portion is disposed to be spaced apart from the second sidewall portion at a predetermined interval, and at least part of the variable portion is movable toward the second sidewall portion.

5. The connector of claim 1, wherein the variable portion applies an elastic force toward the fastening portion.

6. The connector of claim 1, wherein a fastening protrusion is formed on the fastening portion.

7. The connector of claim 1, wherein at least part of the variable portion is curved to protrude toward the fastening portion.

8. The connector of claim 1, wherein the conductive pin further includes an extending portion extending from the fastening portion to face away from the connecting portion with respect to the fastening portion, and wherein at least part of the extending portion faces the fastening portion, and the first sidewall portion is formed between the extending portion and the fastening portion.

9. The connector of claim 8, wherein a through-hole is formed through the first sidewall portion to the bottom portion, and at least part of the extending portion is inserted into the through-hole.

10. The connector of claim 8, wherein the extending portion includes a fixed portion configured to face the fastening portion and a connection portion extending from the fixed portion, and wherein the connection portion is connected to a PCB.

11. The connector of claim 10, wherein the connection portion extends in a direction parallel to the connecting portion.

12. The connector of claim 1, wherein the second sidewall portion has a receiving recess formed thereon for receiving at least part of the variable portion.

13. The connector of claim 12, wherein the variable portion is connected with the opening formed in the bottom portion.

14. An electronic device comprising:

a first PCB disposed in the electronic device, the first PCB including one or more pieces of first wiring;

a first connector mounted on the first PCB and electrically connected with the first wiring;

a second PCB disposed in the electronic device, the second PCB including one or more pieces of second wiring;

a second connector mounted on the second PCB and electrically connected with the second wiring; and a cable configured to electrically connect the first wiring of the first PCB and the second wiring of the second PCB, wherein the cable includes a first corresponding connector coupled to the first connector and a second corresponding connector coupled to the second connector, wherein each of the first connector and the second connector includes:

an insulating member including a first sidewall portion, a second sidewall portion configured to face the first sidewall portion, a bottom portion configured to connect the first sidewall portion and the second sidewall portion, the bottom portion having an opening formed between the first sidewall portion and the second sidewall portion, and a support portion extending from the bottom portion into the opening to cover part of the opening; and a conductive pin including a fastening portion disposed on the first sidewall portion, a variable portion configured to face the fastening portion, and a connecting portion configured to connect the fastening portion and the variable portion and supported by the support portion, wherein the support portion has a smaller thickness than the bottom portion, wherein the first corresponding connector and the second corresponding connector are inserted between the fastening portions and the variable portions of the first connector and the second connector, respectively, wherein the support portion includes:

a first area extending from an edge of the opening in a lengthwise direction of the connecting portion by a first distance; and second areas formed on opposite sides of the first area, the second areas extending from the edge of the opening in the lengthwise direction of the connecting portion by a second distance greater than the first distance, and wherein the second areas support opposite lateral end portions of the connecting portion.

* * * * *